United States Patent [19]

Shapiro et al.

[11] 4,140,405

[45] Feb. 20, 1979

[54] SIGN LETTER STRUCTURE

[75] Inventors: Jay B. Shapiro, Roslyn; William Bank, Brooklyn, both of N.Y.

[73] Assignee: Anchor Plastics Company Inc., Long Island City, N.Y.

[21] Appl. No.: 785,670

[22] Filed: Apr. 7, 1977

[51] Int. Cl.[2] ..... G09F 13/08

[52] U.S. Cl. ..... 40/552; 40/596; 40/616; 40/618

[58] Field of Search ..... 40/130 D, 130 K, 125 E, 40/132 R, 132 D, 136, 140, 552, 546, 596, 564, 573, 616, 618, 615

[56] References Cited

U.S. PATENT DOCUMENTS

| | | | |
|---|---|---|---|
| 1,081,080 | 12/1919 | Wiley | 40/136 X |
| 1,887,748 | 11/1932 | Block | 40/130 K |
| 2,623,315 | 12/1952 | Owen et al. | 40/130 D |
| 2,886,911 | 5/1959 | Hardesty | 40/130 K |
| 3,254,436 | 6/1966 | Bank | 40/130 D |
| 3,566,525 | 3/1971 | Nassil et al. | 40/130 D |

*Primary Examiner*—John F. Pitrelli
*Assistant Examiner*—G. Lee Skillington
*Attorney, Agent, or Firm*—David R. Treacy; Robert S. Smith

[57] ABSTRACT

A sign letter structure for use in an illuminated sign and a composite extruded thermoplastic strip conforming to the periphery of a generally flat letter-form making up the sign, the extruded strip having parallel longitudinally extending spaced opaque sections with a transparent thermoplastic section therebetween, the perimetrical edging of the strip extending inwardly of the frame with the front surface of the edge in contact with the front surface of the letter-form, the transparent section having a convex outer surface and a ridged inner surface for picking up light rays and for diffusing such light rays after they have passed through the transparent section.

14 Claims, 3 Drawing Figures

SIGN LETTER STRUCTURE

This invention relates to sign letter structures and, more particularly, to letter structures in which translucent letter-forms are mounted on an opaque frame usually containing a light source.

In U.S. Pat. No. 3,254,436, dated June 7, 1966, and granted to one of the inventors herein, there is shown and described a sign letter construction in which a letter-form of translucent material is mounted in a frame. The frame is made up of a metal strip embedded in transparent plastic. When the sign is illuminated, all of the illumination passes forwardly through the letter-form.

While the sign letter construction of the U.S. Pat. No. 3,254,436 provides a sign having an attractive and appealing appearance, the effect of the illumination, when the sign is illuminated and viewed in the dark or at night, is only obtained when the sign letters are viewed from the front of the sign. As the sign is viewed from the side, at an angle, illumination is substantially limited. Furthermore, when viewed from the front, the translucent material of the letter-forms and the framing of such forms with the opaque framing material tends to subdue and mute the illumination effects.

The instant invention improves and enhances the attraction and appearance of such signs. In the instant invention, it has been discovered that the attraction and appearance of letter-form signs can be substantially improved and enhanced by providing light passages through the letter-form side frame member behind the letter-form. Such light passages are provided as strips extending longitudinally of the side frame at a uniform distance from the side frame edge. This is accomplished by spacing and embedding metal strips or metal foils between plies of transparent thermoplastic as the side frame material is produced. The strips or foils are spaced so that, when embedded in the transparent thermoplastic, the strips are substantially planar and form plies extending longitudinally and parallel along the composite sign frame strip material. The strips are placed so that one strip extends longitudinally along one marginal edge of the composite strip member and the other strip extends substantially in the same plane with the first strip with the adjacent marginal edges of the strips spaced from each other. The area in the composite strip between the adjacent edges of the strips is filled with the transparent plastic material of the thermoplastic plies. Preferably, ridges or protuberances of the transparent plastic are formed on the inner and outer surface of the frame strip at the transparent areas. For purposes more fully described hereinafter, the surface of the protuberances on the outer surface of the frame strip may be frosted.

In daylight, ambient light striking the letter side frame is reflected by the metal strip or foil in the transparent thermoplastic, giving the letter frame the appearance of metal. Some of such ambient light, especially where the daylight is bright, may pass through the transparent area of the side frame and be reflected through the letter-form, illuminating the letter. At night or in the dark, the letter-forms are illuminated from the rear of the letters. The translucent material of the letter-form is, thus, illuminated. A portion of the light from the illumination at the rear of the letters strikes the ridges or protuberances on the inner surface of the transparent frame strip area, passes through such transparent area and forms a neon tube-like illumination around the letter form. Strips having a woodgrain appearance or which are opaque may be substituted for the metal strips or foils where a woodgrain or plain opaque daylight appearance in the letter frame is desired. Rather than metal, foil or opaque strips, the thermoplastic might be colored with an opaque die or other opaque material and the side frame strip might be extruded with spaced opaque thermoplastic sections with transparent thermoplastic sections therebetween.

The invention of the present application will be more fully understood from the following description of a preferred embodiment of the invention, taken with the appended drawings, in which.

Figure 2:
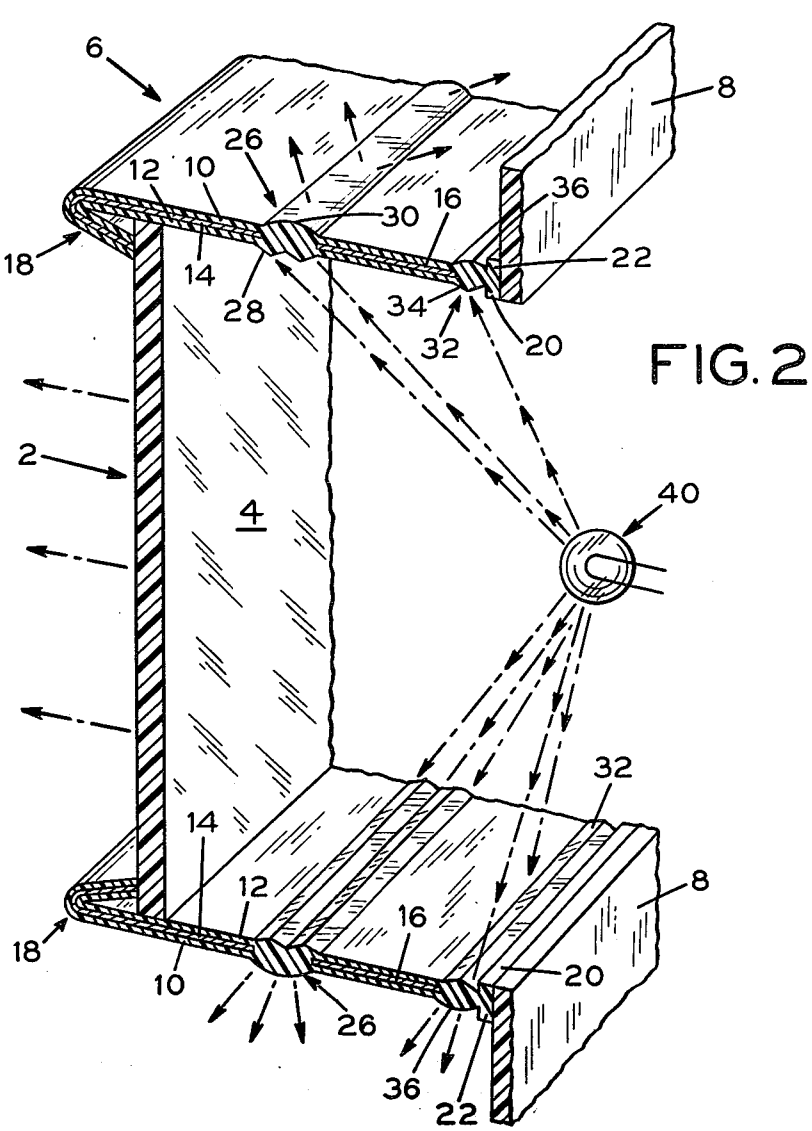
FIG. 2 is an enlarged sectional view taken at line 2—2 in FIG. 1.
Figure 1:
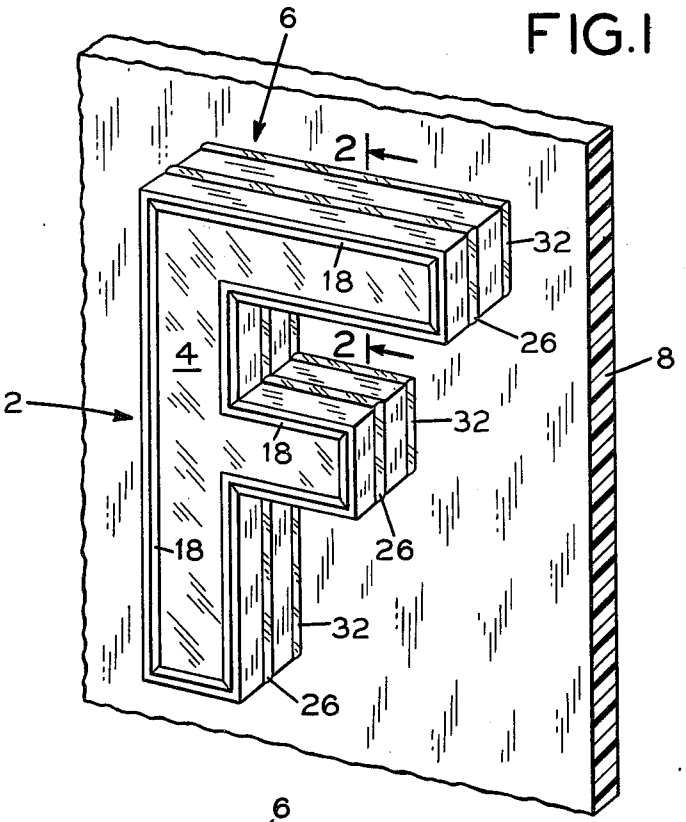
FIG. 1 is a perspective view of a letter structure embodying the invention.

Referring to the drawings and particularly FIGS. 1 and 2, the sign letter, generally designated 2, includes a generally flat transparent or translucent letter-form 4 in a frame, generally designated 6. Letter-form 4 may be cut or cast from a suitable transparent or translucent material, preferably, transparent or translucent plastic. The transparent or translucent material may be colorless, may be white or may be colored depending upon the design of the sign. Frame 6 is of strip material bent and shaped to conform to the letter-frame contour. For reasons more apparent hereinafter, sign letter 2 is mounted on an opaque or translucent support 8.

Referring to FIG. 2, frame 6 includes an outer ply 10, an inner ply 12 and spaced strips 14, 16 of metal foil or other opaque interface material positioned between and embedded in inner and outer plies 10, 12. Strip 14 is embedded in plies 10, 12 at the longitudinal marginal edge of the composite strip material. Strip 16 is embedded adjacent to or may be spaced from the opposite marginal edge of the strip material. For purposes more fully described hereinafter, edge 18 of frame member 6 is bent angularly inwardly and backwardly toward the center of the strip. The opposite edge of the strip member 6, may be plain or may extend inwardly and outwardly, as at 20, 22.

Preferably, plies 10, 12, with edge 18 bent inwardly are extruded with strips 14, 16 embedded and spaced therein. As best shown in FIG. 2, strip 14 is embedded at one of the longitudinal edges so that it extends through and along bent edge 18 and along the flat portion of strip 6. In the illustrated embodiment, strip 16 is embedded adjacent to, but spaced from the other longitudinal edge of strip 6. The adjacent marginal edges of strip 14, 16 are spaced and, as strip 6 is extruded, a strip of transparent or translucent plastic section 26 is formed therebetween. The inner surface 28 of transparent or translucent plastic section 26 is formed into ridges extending longitudinally of strip 6 and spaced from the opposite marginal edges of the strip. The outer surface 30 of transparent or translucent strip 26 is convex and, preferably, arcuate. Surface 30 may be etched or frosted to better diffuse the light passing therethrough.

Figure 3:
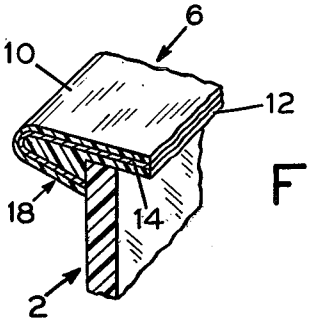
FIG. 3 is a partial sectional view of a modified construction of the frame member of FIG. 2.

In addition to the transparent or translucent strip 26, in the illustrated embodiment of the invention, a second transparent or translucent plastic strip 32 is formed in the extrusion between the edge of foil strip and the spaced marginal edge 20, 22 of composite strip 6. Like transparent or translucent plastic strip 26, the second transparent or translucent strip 32 may be extruded with an inner ridged surface 34 and an outer convex or arcuate surface 36. The outermost surface of arcuate surface 36 may be etched or frosted to better diffuse light passing therethrough. Strip 6 may be extruded with the enclosed edge at bent edge 18 open, as shown in FIG. 2 but, for rigidity, may be extruded with the enclosed edge partially filled or competely filled with the plastic extrudate, as shown in FIG. 3. Preferably, bent edge 18 is filled with the plastic extrudate to form a surface for ease of attachment of the frame to the letter-form.

Composite strip 6 is extruded as a continuous strip and grooved, mitred and cut to form a frame around letter-form 4. The front or face of letter-form 4, of transparent or translucent material, is fitted into the letter frame and abuts the ledge formed by bent-in edge 18. Letter-form 4 is affixed to the frame with a suitable adhesive, cement or solvent which fuses the letter-form material with the frame material. At the inner end 20, 22, the framed letter is affixed to the face of opaque or translucent support 8. A light source 40 is housed behind support 8 which is cut out at the letter-form to permit light rays from light source 40 to pass into the letter frame and out through transparent or translucent letter-form 4.

Some of the light rays from light source 40 in the instant invention strike the ridged surfaces 28, 34 and, from such ridged surface, are transmitted through the transparent or translucent strips 26, 34 emerging from such strips through the convex or arcuate surfaces 30, 36. The etched or frosted outer surfaces at 30, 36 diffuse and spread the light, forming, when such surface is viewed from the exterior of the letter-form, a tube-like light such as would be given off by a lighted neon tube, viewed from a distance. This tube-like light illuminates the sides of the letter, gives the letter a depth when illuminated and viewed at night, tends to frame and accentuate the letter and improves the attraction and appearance of the letters.

In the practice of the instant invention, it is preferred to form transparent or translucent strips through the composite strip material member intermediate the edges of the frame member. It is to be understood, however, that the composite strip might be extruded with a single strip of opaque material, such as metal or metal foil, so that only a translucent or transparent strip adjacent support 8 is formed or with two strips of metal or metal foil so that only the intermediate transparent or translucent strip is formed.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. In an illuminated sign letter structure for use in a sign illuminated from a source positioned rearward of the letter structure, a generally flat letter-form through which light can pass, a composite strip material bent to conform to the perimeter of said letter-form and extending along the perimeter of said letter-form and forming a side frame therearound; said composite strip member comprising an extruded thermoplastic strip having parallel longitudinally extending, spaced opaque thermoplastic sections with a transparent thermoplastic section therebetween, one of said opaque sections extending longitudinally of said strip along one marginal edge of said strip and being in contact along said one marginal edge with said letter-form, the width of said opaque section between said contacting marginal edge and the edge of said transparent section being greater than the thickness of said letter-form; said side frame including a perimetrical edging extending inwardly of said frame from the perimetrical front edge of said frame to said letter-form; the front surface of said inwardly extending edge being in contact with the front surface of said letter-form; said transparent thermoplastic section between said opaque sections forming a light transmitting area extending through and longitudinally along said side frame, parallel to said letter-form, for receiving light from said light source rearward of said letter structure and for transmitting said received light through said side frame.

2. A sign letter structure, as recited in claim 1, in which the surface of the transparent thermoplastic section at the inner surface of said side frame at said light transmitting area includes longitudinally extending ridges extending outwardly from said inner surfaces and inwardly into said letter-form frame for receiving light rays from the illumination within said frame and from behind said letter-form and for transmitting said light rays into and through said light transmitting area.

3. A sign letter structure as recited in claim 2, in which the surface of said transparent thermoplastic section at the outer surface of said side frame includes a longitudinally extending ridge extending outwardly from said surface for diffusing the light rays transmitted through said light transmitting area.

4. A sign letter structure as recited in claim 3, in which said outwardly extending longitudinal ridge is convex.

5. A sign letter structure, as recited in claim 3, in which outwardly extending longitudinal ridge is arcuate.

6. A sign letter structure as recited in claim 4, in which the outer surface of said convex ridge is frosted.

7. In an illuminated sign letter structure for use in a sign illuminated from a source positioned rearward of the letter structure, a generally flat letter-form through which light can pass, a composite strip material member bent to conform to the periphery of said letter-form and extending along the perimeter of said letter-form and forming a side frame therearound; said composite strip member comprising inner and outer transparent plastic plies and spaced opaque plies sandwiched therebetween, one of said opaque plies extending longitudinally of said composite strip along one marginal edge thereof; said letter-form being in contact with at least one of said plastic plies at said one marginal edge and being bonded thereto; the width of said composite strip member and the width of said side frame formed thereby and the opaque ply at said contacting marginal edge being greater than the thickness of said letter-form; said side frame including a perimetrical edging extending inwardly of said frame from the perimetrical front edge of said side frame to said letter-form; the front surface of said letter-form being in contact with the inner perimetrical edge of at least the exposed plastic ply of said edging; the space between said spaced opaque plies and the transparent plastic plies in said space between said opaque plies forming a light transmitting area extending through and longitudinally along said side frame for receiving light from said light source rearward of said letter structure and for transmitting light rays received from said source through said side frame.

8. A sign letter structure, as recited in claim 7, in which the surface of the transparent plastic ply at the inner surface of said side frame at said light transmitting area includes longitudinally extending ridges extending outwardly from said inner surface and inwardly into said letter-form frame for receiving light rays from the illumination within said frame and from behind said letter-form and for transmitting said light rays into and through said light transmitting area.

9. A sign letter structure, as recited in claim 8, in which the surface of the transparent plastic ply at the outer surface of said side frame at said light transmitting area includes a longitudinally extending ridge extending outwardly from said surface for diffusing the light rays transmitted through said light transmitting area.

10. A sign letter structure, as recited in claim 9, in which said outwardly extending longitudinally ridge is convex.

11. A sign letter structure, as recited in claim 7, in which said outwardly extending longitudinal ridge is arcuate.

12. A sign letter structure, as recited in claim 10, in which the outer surface of said convex ridge is frosted.

13. A sign letter structure, as recited in claim 7, in which said opaque plies are of metal foil.

14. A sign letter structure, as recited in claim 11, in which the outer surface of said arcuate ridge is frosted.

* * * * *

UNITED STATES PATENT AND TRADEMARK OFFICE

CERTIFICATE OF CORRECTION

PATENT NO. : 4,140,405

DATED : February 20, 1979

INVENTOR(S) : Jay B. Shapiro, William Bank

It is certified that error appears in the above-identified patent and that said Letters Patent are hereby corrected as shown below:

On the Abstract page of the Letters Patent, under "Attorney, Agent or Firm," cancel David R. Treacy; Robert S. Smith", and substitute--James P. Welch; Morgan, Finnegan; Pine, Foley and Lee--

In claim 10, line 2, cancel "Longitudinally" and substitute --longitudinal--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*